US007982131B2

(12) United States Patent
Fagrenius et al.

(10) Patent No.: US 7,982,131 B2
(45) Date of Patent: Jul. 19, 2011

(54) AUTOMATICALLY FOLDING CABLE

(75) Inventors: Gustav Nils Fagrenius, Dalby (SE); Fredrik Sven Rune Palmqvist, Staffanstorp (SE); Martin Johan Wedel, Furulund (SE); Magnus Carl Waldt, Kävlinge (SE); Tina Eva Rålin, Malmö (SE); Ola Sten Håkansson, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 1423 days.

(21) Appl. No.: 11/421,286

(22) Filed: May 31, 2006

(65) Prior Publication Data

US 2007/0279072 A1 Dec. 6, 2007

(51) Int. Cl.
*H01B 7/00* (2006.01)

(52) U.S. Cl. ..... 174/111

(58) Field of Classification Search ..... 174/111, 174/69, 135

See application file for complete search history.

(56) References Cited

U.S. PATENT DOCUMENTS

| | | | | |
|---|---|---|---|---|
| 2,899,549 | A * | 8/1959 | Potter | 455/269 |
| 3,516,399 | A * | 6/1970 | Barefoot | 600/505 |
| 6,363,158 | B1 | 3/2002 | Lu | |
| 2003/0070832 | A1 * | 4/2003 | Potter et al. | 174/118 |
| 2007/0144376 | A1 * | 6/2007 | Jostmeier et al. | 101/350.1 |
| 2009/0314515 | A1 * | 12/2009 | Bevirt et al. | 174/110 R |

FOREIGN PATENT DOCUMENTS

| | | | |
|---|---|---|---|
| EP | 1 182 848 | A1 | 2/2002 |
| FR | 2 865 860 | A | 8/2005 |
| GB | 869275 | A | 5/1961 |
| KR | 20-0301311 | | 1/2003 |

OTHER PUBLICATIONS

European Office Action issued in co-pending European Patent Application No. 06832029.0-1231, Mar. 18, 2010, 4 pages.

International Search Report and Written Opinion for PCT/IB2006/054536, mailed Jul. 6, 2007, (13 pages).

International Preliminary Report on Patentability mailed Sep. 18, 2008 issued in corresponding international application No. PCT/IB2006/054536, 9 pages.

* cited by examiner

*Primary Examiner* — Chau N Nguyen

(74) *Attorney, Agent, or Firm* — Snyder, Clark, Lesch & Chung, LLP

(57) ABSTRACT

A cable includes a sheath extending a length of the cable. The cable further includes a flexible wire disposed within the sheath that runs a substantial portion of the length of the cable. The wire acts to fold the cable in a pre-defined configuration. In some implementations, the cable also includes magnets disposed on or within the sheath. The magnets act to fold the cable in the pre-defined configuration in conjunction with the flexible wire.

23 Claims, 10 Drawing Sheets

AUTOMATICALLY FOLDING CABLE

TECHNICAL FIELD OF THE INVENTION

Implementations described herein relate generally to cables and, more particularly, to cables that automatically fold in a pre-defined manner.

BACKGROUND

Connective cables are used in many different existing applications. Cables for connecting speakers to compact disc (CD) players, cables for connecting headphones or earpieces to MP3 players, or cables for connecting "hands free" microphones and/or earpieces to cellular telephones are just a few examples of the numerous applications that use connective cables. Connective cables may, thus, be used in many different applications that, for example, involve portable devices that users can carry with them. Use of connective cables with such devices often involves the user repeatedly connecting the cable to the device (e.g., for listening to an audio output), disconnecting the cable, and stowing the cable away (e.g., storing in a pocket or a bag). This repeated process often results in connective cabling that becomes entangled and, thus, is difficult to subsequently retrieve from storage and use again without having to disentangle the connective cable.

SUMMARY

According to one aspect, a cable may include a sheath extending a length of the cable. The cable may further include a flexible wire disposed within the sheath that runs a substantial portion of the length of the cable, wherein the wire acts to fold the cable in a pre-defined configuration.

Additionally, the cable may include magnets disposed on or within the sheath, where the magnets act to fold the cable in the pre-defined configuration in conjunction with the flexible wire.

Additionally, the magnets are disposed at selected locations along the length of the cable to fold the cable in the pre-defined configuration.

Additionally, the cable is deformable but returns to the pre-defined configuration after being released from an unfolded state due to attraction of the magnets to one another.

Additionally, the magnets may include electromagnets and a voltage is applied to the electromagnets to fold the cable in the pre-defined configuration.

Additionally, the magnets may include electromagnets and a voltage is removed from the electromagnets such that the cable can be unfolded from the pre-defined configuration.

Additionally, the flexible wire is formed within the sheath in the pre-defined configuration.

Additionally, the flexible wire is deformable but returns to the pre-defined configuration after being released from an unfolded state.

Additionally, the pre-defined configuration includes a coiled configuration.

According to another aspect, a cable may include a sheathing material extending a length of the cable. The cable may further include magnets disposed on or within the sheathing material, wherein the magnets act to fold the cable in a pre-defined formation.

Additionally, the magnets are disposed at selected locations along the length of the cable to fold the cable in the pre-defined formation.

Additionally, the cable is deformable but returns to the pre-defined formation after being released from an unfolded state due to attraction of the magnets to one another.

Additionally, the pre-defined formation includes a coiled formation.

Additionally, the magnets include electromagnets and a voltage is applied to the electromagnets to fold the cable in the pre-defined formation.

Additionally, the magnets include electromagnets and a voltage is removed from the electromagnets such that the cable can be unfolded from the pre-defined formation.

According to a further aspect, a system includes a cable and electromagnets disposed on or within the cable, wherein the electromagnets act to fold the cable in a pre-defined configuration or to release the cable from the pre-defined configuration based on an applied voltage.

Additionally, the electromagnets are disposed at selected locations along a length of the cable to fold the cable in the pre-defined configuration.

Additionally, the cable returns to the pre-defined configuration from an unfolded state due to attraction of the electromagnets to one another.

Additionally, the cable is released from the pre-defined configuration when a voltage is removed from being applied to the electromagnets.

Additionally, the system further includes a first electrical wire disposed within the cable, a second electrical wire disposed within the cable, an external speaker and a cellular radiotelephone connected to the external speaker via the first electrical wire. The cellular radiotelephone removes a voltage being applied to the electromagnets via the second electrical wire when the radiotelephone receives a call, permitting the cable to be unfolded from the pre-defined configuration.

According to an additional aspect, a system may include a cable, a cellular radiotelephone, a microphone and/or an ear piece connected to the cellular radiotelephone via one or more electrical wires disposed within the cable. The system may further include a flexible wire disposed within the cable that runs a substantial portion of a length of the cable, where the flexible wire acts to return the cable to a pre-defined folded configuration when the cable has been unfolded.

Additionally, the flexible wire is formed within the cable in the pre-defined configuration.

Additionally, the pre-defined configuration comprises a coiled configuration.

Additionally, the system further may include magnets disposed on or within the cable, where the magnets act, in conjunction with the flexible wire, to return the cable to the pre-defined configuration when the cable has been unfolded.

Additionally, the magnets are disposed at selected locations along a length of the cable to return the cable to the pre-defined configuration when the cable has been unfolded.

Additionally, the cable returns to the pre-defined configuration after being released from an unfolded state due to attraction of the magnets to one another.

Additionally, the magnets may include electromagnets and a voltage is applied to the electromagnets to fold the cable into the pre-defined formation.

Additionally, the magnets may include electromagnets and a voltage is removed from being applied to the electromagnets such that the cable can be unfolded from the pre-defined formation.

It should be emphasized that the term "comprises/comprising" when used in this specification is taken to specify the presence of stated features, integers, steps, components or groups but does not preclude the presence or addition of one or more other features, integers, steps, components or groups thereof.

BRIEF DESCRIPTION OF THE DRAWINGS

The accompanying drawings, which are incorporated in and constitute a part of this specification, illustrate one or more embodiments of the invention and, together with the description, explain the invention. In the drawings.

DETAILED DESCRIPTION OF EMBODIMENTS

The following detailed description of the invention refers to the accompanying drawings. The same reference numbers in different drawings may identify the same or similar elements. Also, the following detailed description does not limit the invention.

Consistent with aspects of the invention, a connective cable may include an internal wire composed of a material that acts to automatically return the cable to a pre-defined folded configuration after the cable is unfolded by a user. The internal wire may be formed in the pre-defined configuration, thus, causing the cable to fold itself automatically. In some implementations of the invention, magnets may further be disposed at selected locations on or within the connective cable. The magnetic attraction between the magnets, in conjunction with the internal wire, may cause the cable to return to a pre-defined folded configuration after the cable has been unfolded by a user. In a further implementation, the magnets may include electromagnets. Application of a voltage to the electromagnets, in conjunction with action of the internal wire, causes the cable to fold itself in the pre-defined configuration. Removal of the applied voltage to the electromagnets enables the cable to be unfolded from the pre-defined configuration.

Figure 1:
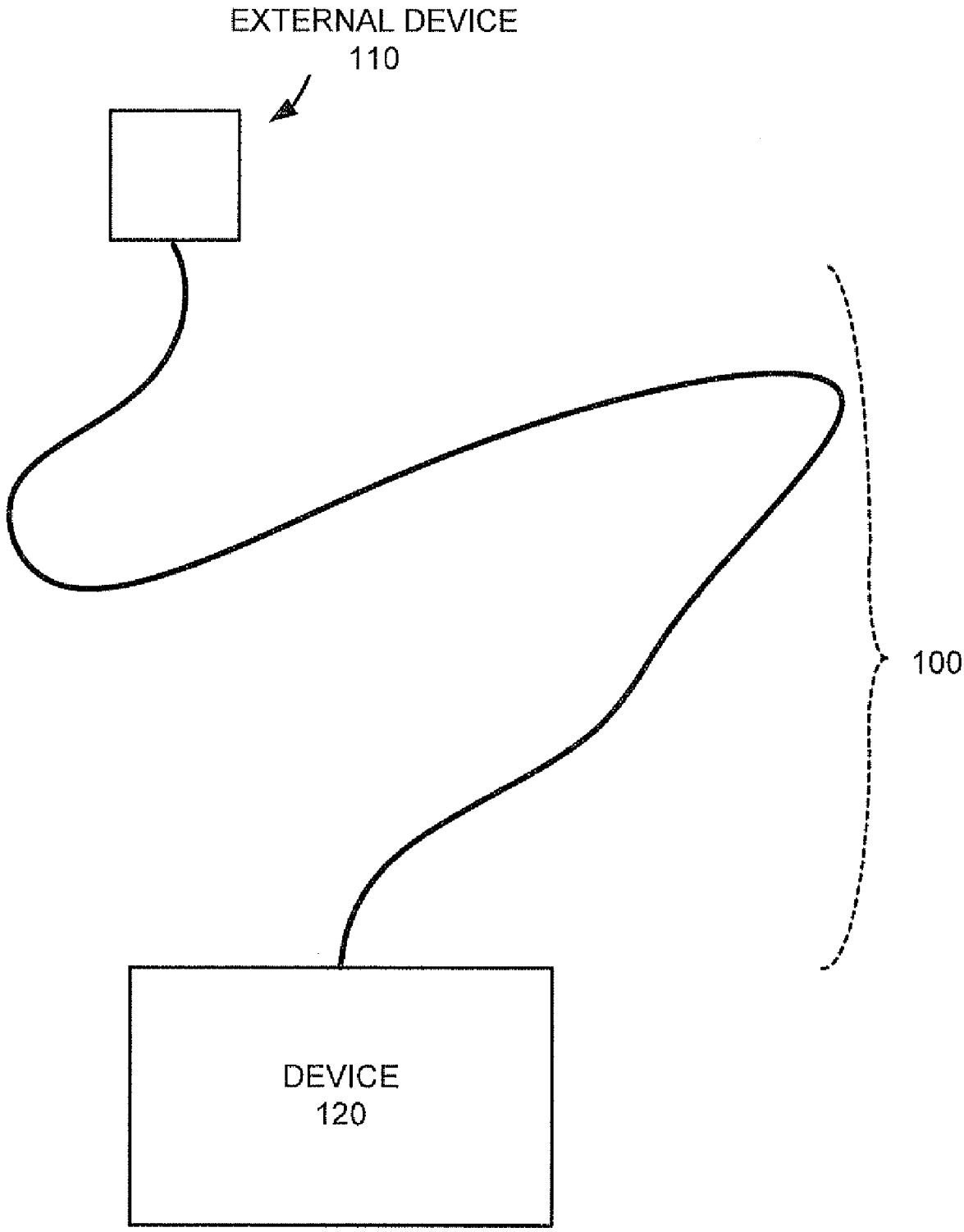
FIG. 1 illustrates an exemplary cable connecting an external device with another device consistent with principles of the invention.

FIG. 1 illustrates an exemplary cable 100 that connects an external device 110 with another device 120. Device 120 may include any type of device that provides electrical signals to or from an external device, or to or from another device. Device 120 may include, for example, a compact disc (CD) player, a digital video disc (DVD) player, a cellular telephone, an MP3 player, an audio recorder, a personal computer, a laptop or palmtop computer, a telephone, a television, a cellular radiotelephone, a Personal Communications System (PCS) terminal, a personal digital assistant (PDA), or the like. A PCS terminal may combine a cellular radiotelephone with data processing, facsimile and/or data communications capabilities. A PDA may include a radiotelephone, a pager, Internet/intranet access, a web browser, an organizer, calendars and/or a global positioning system (GPS) receiver. In some implementations, device 120 may include a portable device.

External device 110 may include any type of device that sends or receives electrical signals to or from device 120. External device 110 may include, for example, a microphone that sends an audio input to device 120. External device 110 may further include, for example, speakers, headphones, or external ear pieces that convert electrical signals received from device 120 into an auditory output.

Cable 100, consistent with principles of the invention, may include folding mechanisms, described further below, that cause cable 100 to automatically fold in a pre-defined configuration after cable 100 has been unfolded by a user. The mechanisms associated with cable 100, which cause cable 100 to fold in a pre-defined configuration, may, thus, prevent cable 100 from becoming entangled. The folding mechanisms, consistent with principles of the invention, therefore, permit ease of use and storage of cable 100 when a user uses cable 100 to interconnect external device 110 with device 120.

Figure 2:
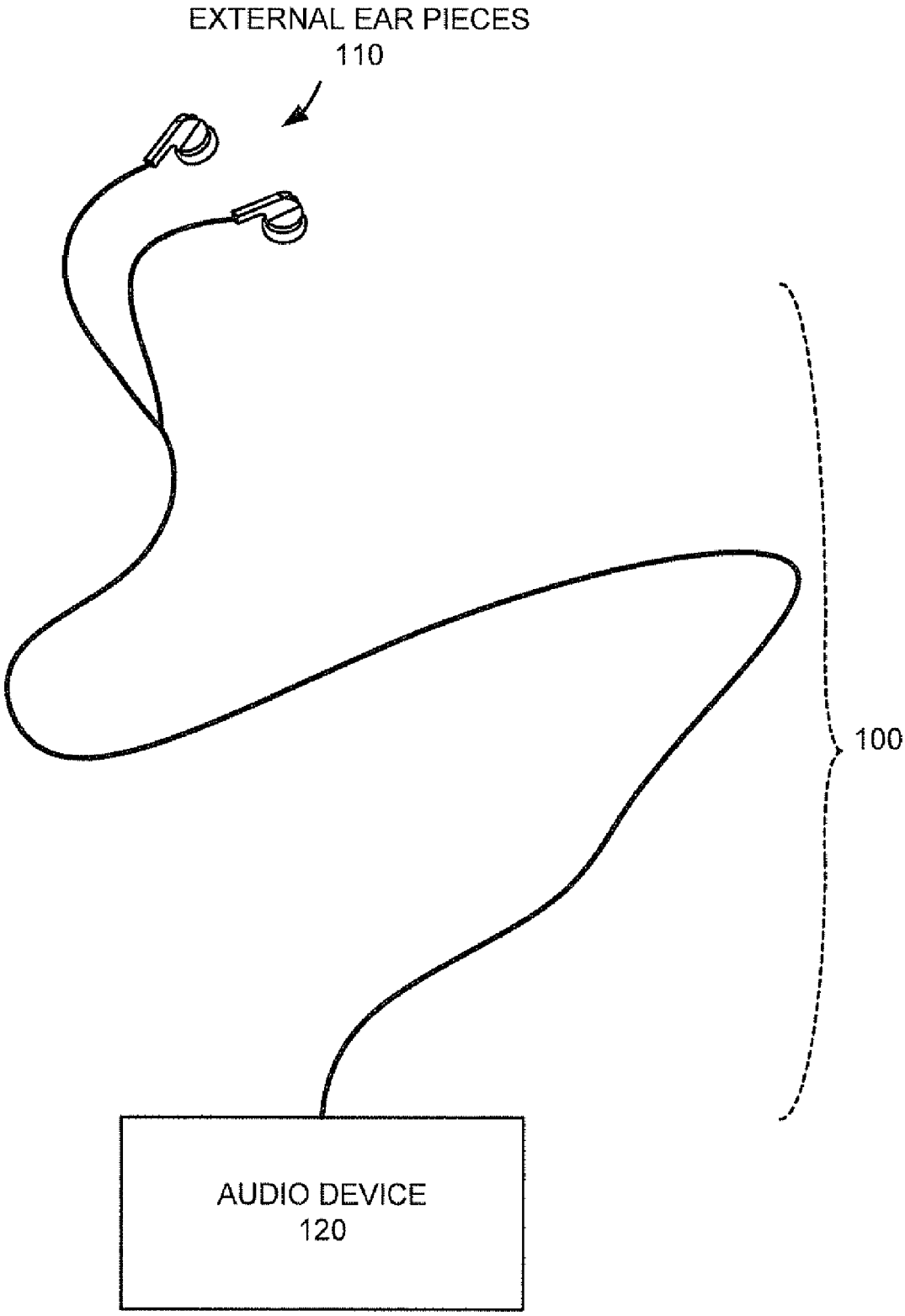
FIG. 2 illustrates an exemplary implementation in which a cable interconnects external earpieces with an audio device consistent with principles of the invention.

FIG. 2 illustrates an exemplary implementation of cable 100 of FIG. 1 in which cable 100 interconnects one or more external ear pieces 110 with an audio device 120, such as, for example, a cellular radiotelephone. External ear pieces 110 may include a portion of a "hands free" head set that permits a user to communicate via the cellular radiotelephone without using the user's hands. The "hands free" head set may include a microphone (not shown) in addition to one or more external ear pieces 110. In the exemplary implementation of FIG. 2, cable 100 may, using folding mechanisms described further below, automatically fold cable 100 into a pre-defined formation after use of external ear pieces 110. Cable 100 may have an outer sheath having a diameter appropriate to the particular audio device 120. Cable 100, for example, may have a length ranging from about 90 cm to about 150 cm. In one specific implementation, cable 100 may have a length of approximately 120 cm.

Figure 3A:
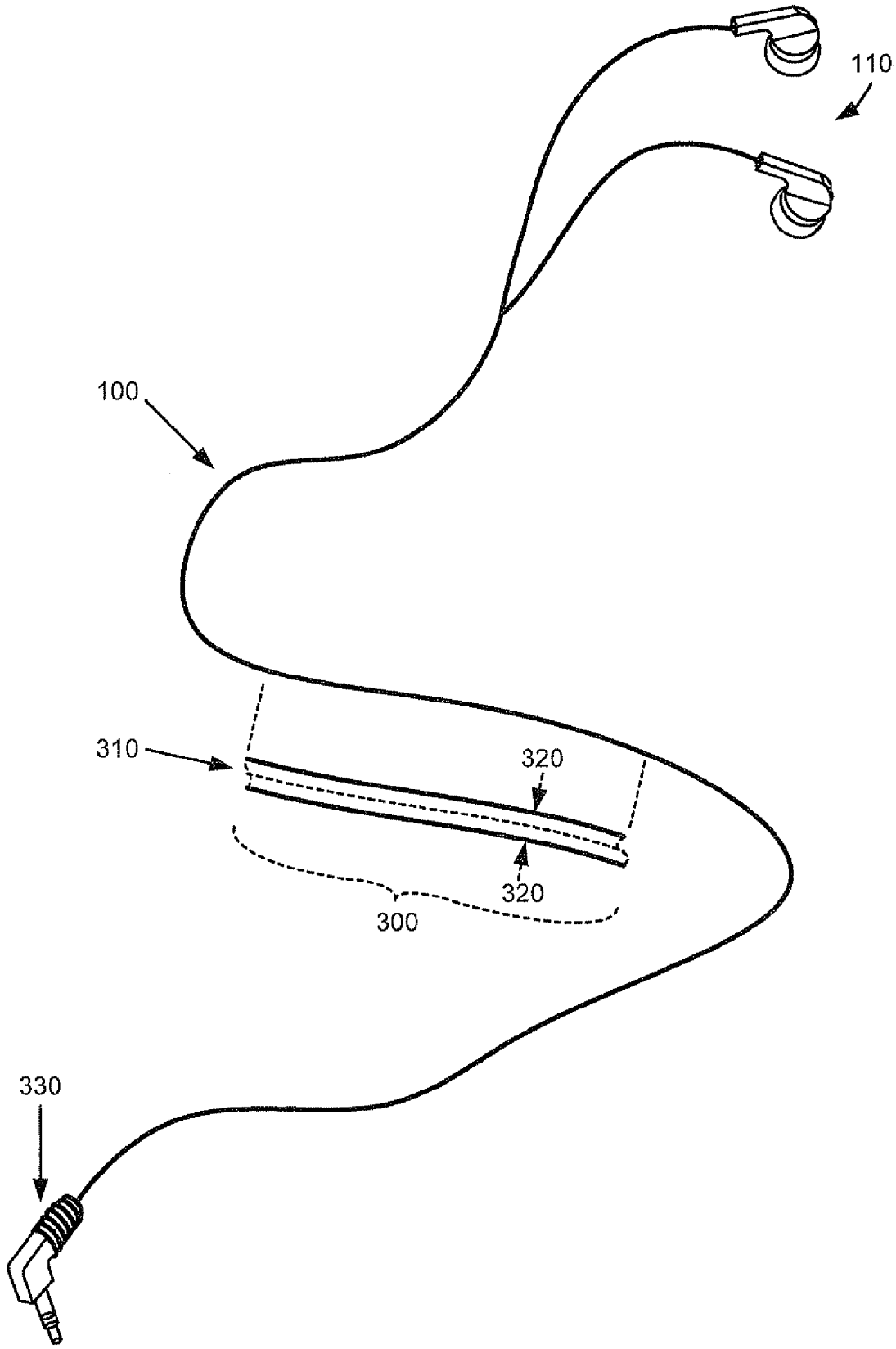
FIG. 3A illustrates an exemplary cable in an un-folded state that includes a folding internal wire consistent with principles of the invention.

FIG. 3A illustrates one exemplary implementation of the invention in which cable 100 includes an internal folding wire that folds cable 100 into a pre-defined configuration after use. Cable 100 is shown in FIG. 3A in an unfolded state, where a user has unfolded cable 100 from its pre-defined folded configuration. As shown in FIG. 3A, cable 100 includes ear pieces 110 at one end of cable 100 and a connector terminal 330 at the other end of cable 100. As further shown in the cut-away view 300 of cable 100, cable 100, in addition to an electrical wire (not shown) for conveying an electrical signal from connector terminal 330 to ear pieces 110, may include a folding wire 310 within the sheathing 320 of cable 100. Folding wire 310 may include, for example, a metal wire that is formed in the pre-defined configuration and that may further be deformed from the pre-defined configuration. Folding wire 310 may, however, include a "memory" property that causes the metal wire to return to its pre-defined configuration after it has been deformed. Folding wire 310 may include any type of material, or combination of materials, that has "spring-like" memory properties, including, for example, a metal material.

Figure 3B:
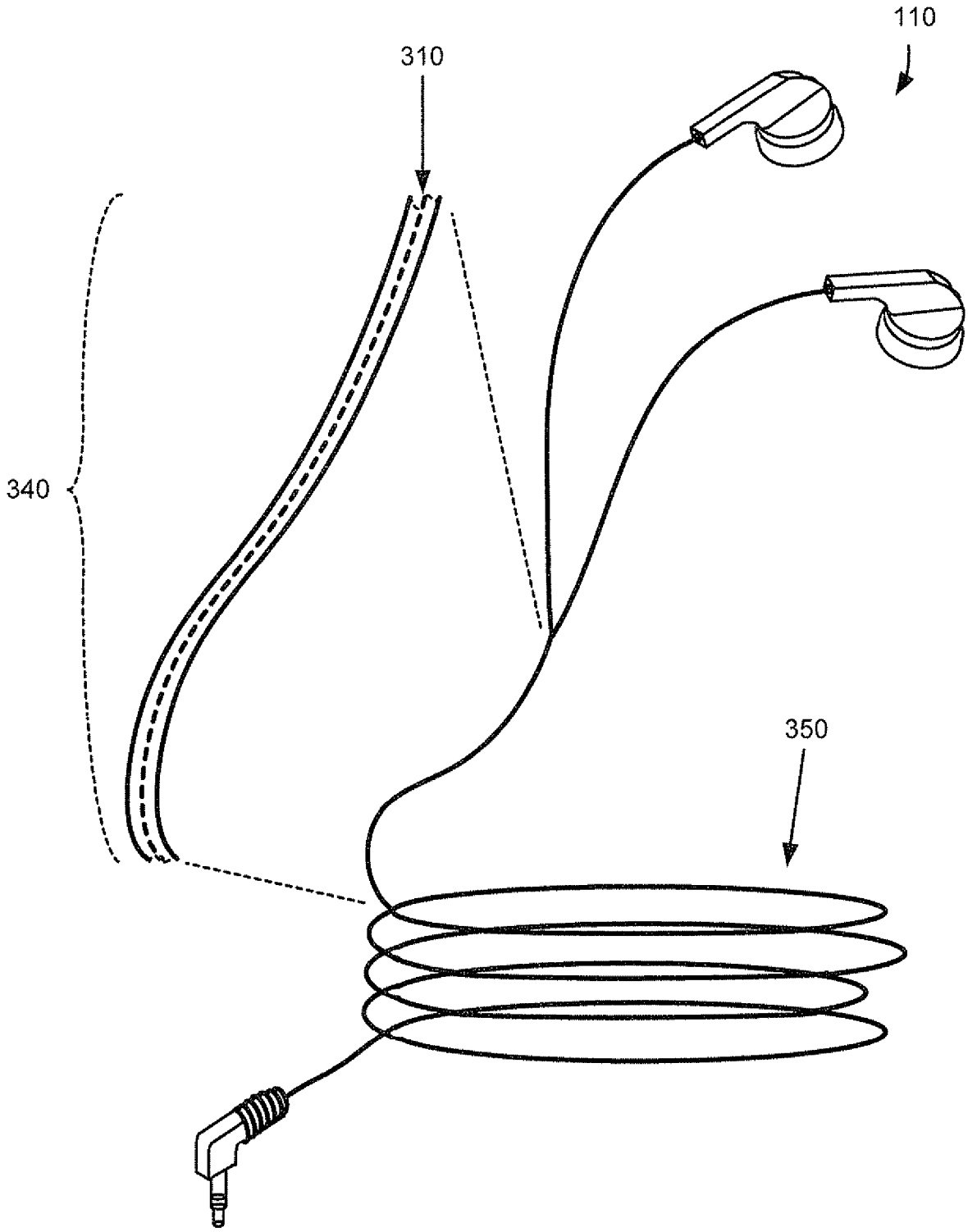
FIG. 3B illustrates the exemplary cable of FIG. 3A returned to a pre-defined folded state due to action of the internal folding wire consistent with principles of the invention.

FIG. 3B further shows cable 100 after it has returned to its pre-defined folded state 350 via action of folding wire 310, shown in the cut-away view 340 of cable 100. The folded state 350 is shown in FIG. 3B as a coiled configuration. However, other configurations may also be used consistent with principles of the invention. When cable 100 is released from its unfolded position by a user using cable 100, folding wire 310 may act to return cable 100 to its pre-defined folded state 350, thus, preventing cable 100 from getting entangled during subsequent storage.

Figure 4A:
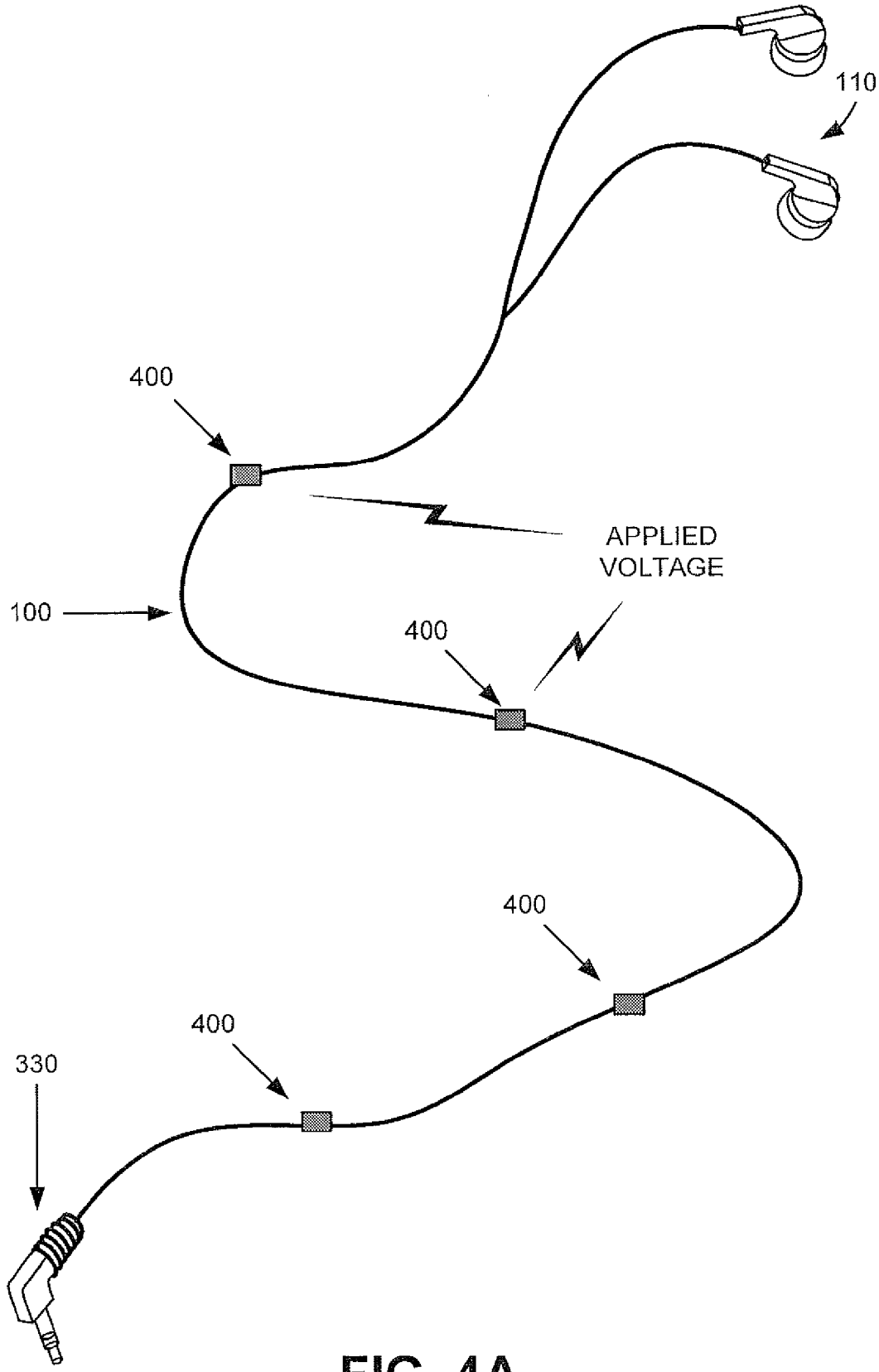
FIG. 4A illustrates an exemplary cable in an un-folded state that includes magnets disposed along a length of the cable consistent with principles of the invention.

FIG. 4A illustrates another exemplary implementation of the invention in which cable 100 includes, in addition to a folding wire 310 (not shown) disposed within cable 100, magnets 400 disposed at selected locations along a length of cable 100. Magnets 400, in conjunction with folding wire 310, may assist in folding cable 100 into a pre-defined configuration after use. Cable 100 is shown in FIG. 4A in an unfolded state, where a user has unfolded cable 100 from its pre-defined folded configuration. As shown in FIG. 4A, cable 100 includes ear pieces 110 at one end of cable 100 and a connector terminal 330 at the other end of cable 100. In the implementation shown in FIG. 4A, cable 100 may have a length ranging from about 90 cm to about 150 cm with about 3 to 20 magnets 400 spaced at selected intervals apart along a length of cable 100. In a further exemplary implementation, magnets 400 may include electromagnets that assist in folding and/or unfolding cable 100 when an electrical voltage is applied to, or removed from, the electromagnets via a circuit including an electrical wire (not shown) disposed within cable 100. For example, if device 120 includes a cellular radiotelephone, the electromagnets can be released (e.g., by removing the electrical voltage supplied to the electromagnets) for an incoming call received at the cellular radiotelephone, enabling the user to easily unfold cable 100.

Figure 4B:
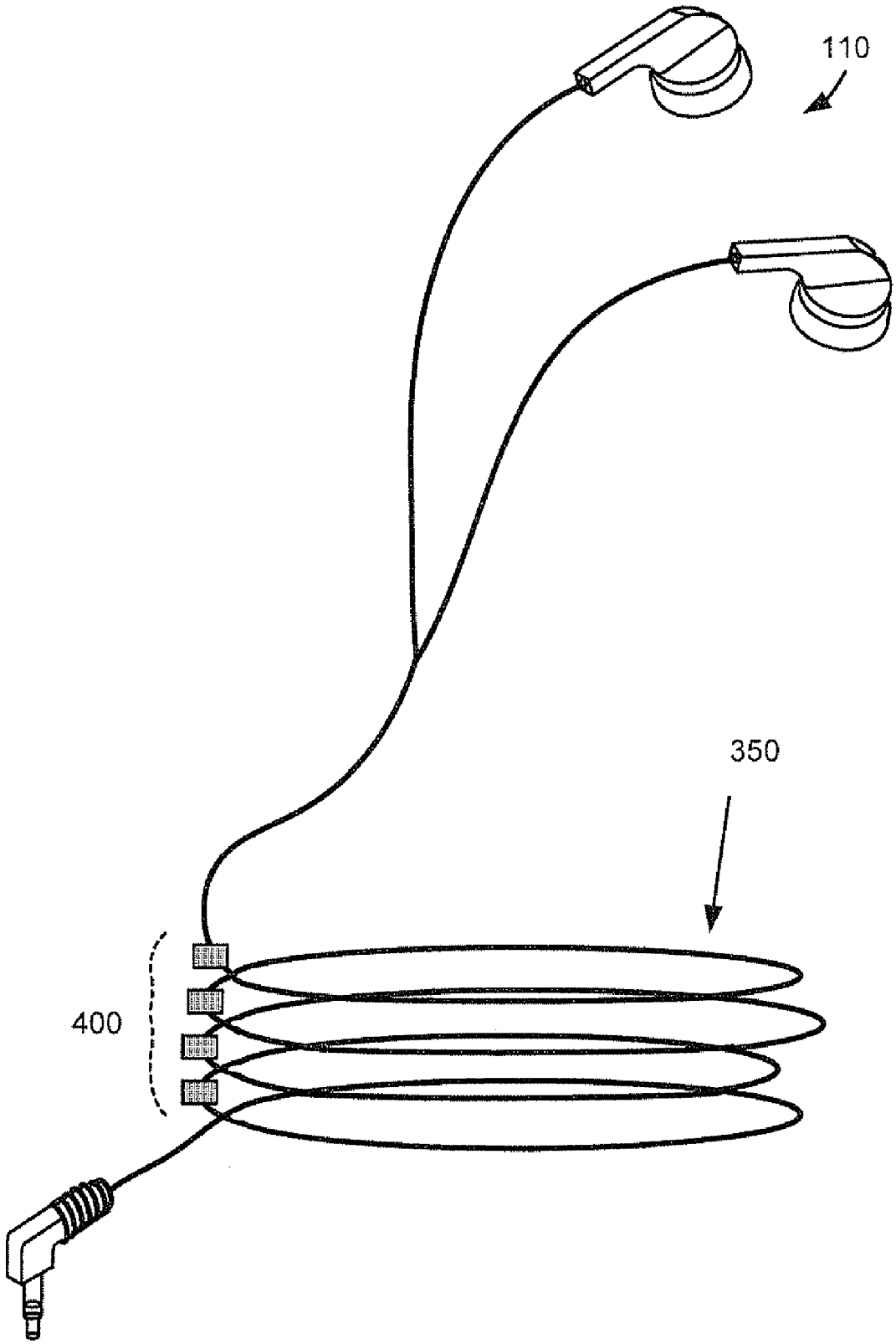
FIG. 4B illustrates the exemplary cable of FIG. 4A returned to a pre-defined folded state due to attraction between the magnets of FIG. 4A consistent with principles of the invention.

FIG. 4B further shows cable 100 after it has returned to its pre-defined folded state 350 via action of folding wire 310 (not shown) and magnets 400. The folded state 350 is shown in FIG. 4B as a coiled configuration. However, other configurations may also be used consistent with principles of the invention. When cable 100 is released from its unfolded position by a user using cable 100, the magnetic attraction between magnets 400 may act, in conjunction with the internal folding wire, to assist in the return of cable 100 to its pre-defined folded state 350, thus, preventing cable 100 from getting entangled during subsequent storage.

Figure 5A:
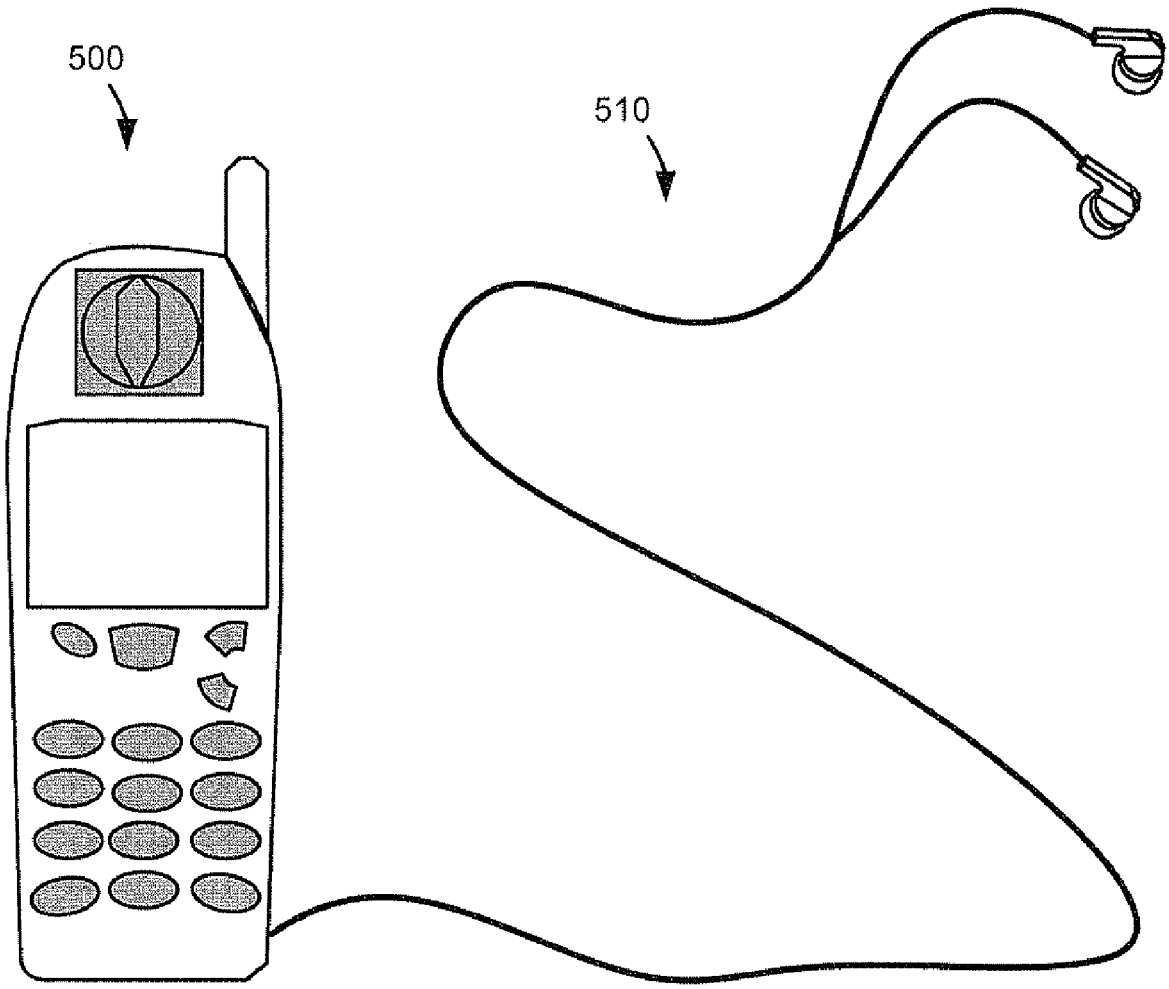
FIGS. 5A and 5B illustrate use of an automatically folding cable with a cellular radiotelephone consistent with principles of the invention.
Figure 5B:
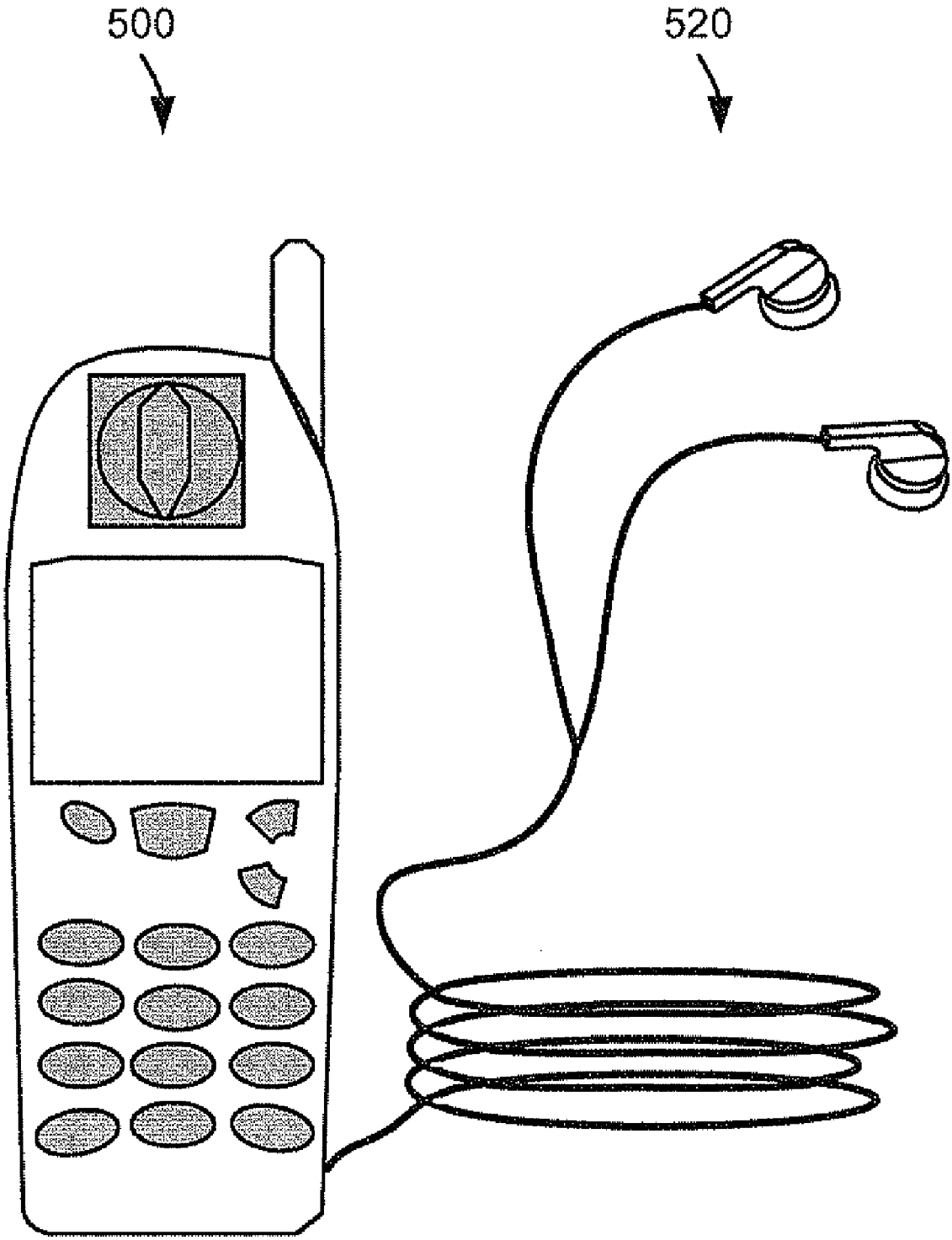

FIGS. 5A and 5B depict the use of the automatically folding cable described above with a cellular radio-telephone 500. As shown in FIG. 5A, a user may unfold and then connect a cable, such as the automatically folding cable described above with respect to FIG. 3A, to cellular radiotelephone 500 to, for example, use a "hands free" headset that includes ear-pieces and a microphone. The cable is shown in FIG. 5A in its unfolded state 510. After the user is through using the "hands free" headset, the user may release the cable, and the internal folding wire, described above, may act to automatically fold the cable into its folded state 520, as shown in FIG. 5B.

Figure 6A:
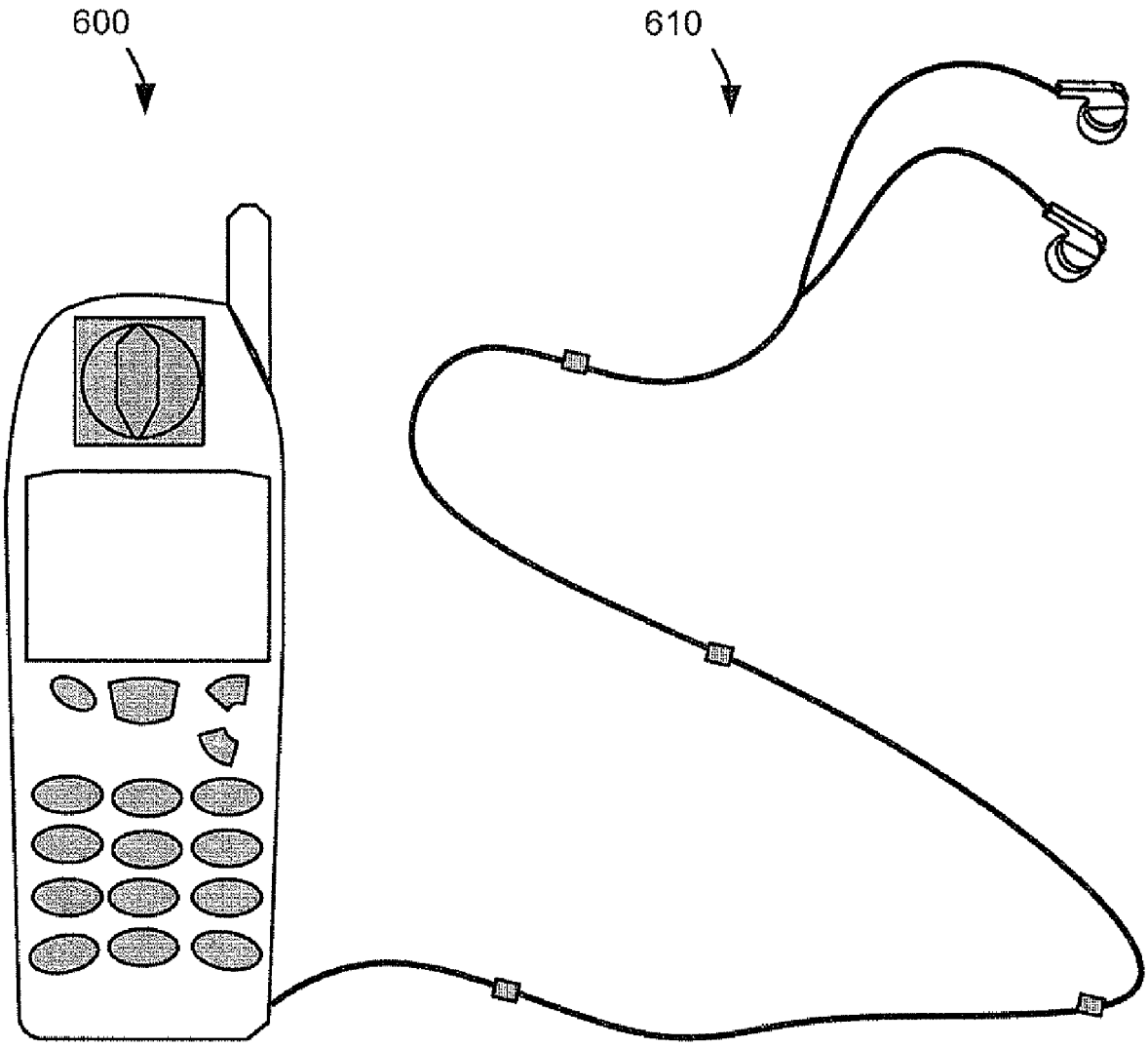
FIGS. 6A and 6B illustrate use of an automatically folding cable, which includes magnets disposed on or within the cable, with a cellular radiotelephone consistent with principles of the invention.
Figure 6B:
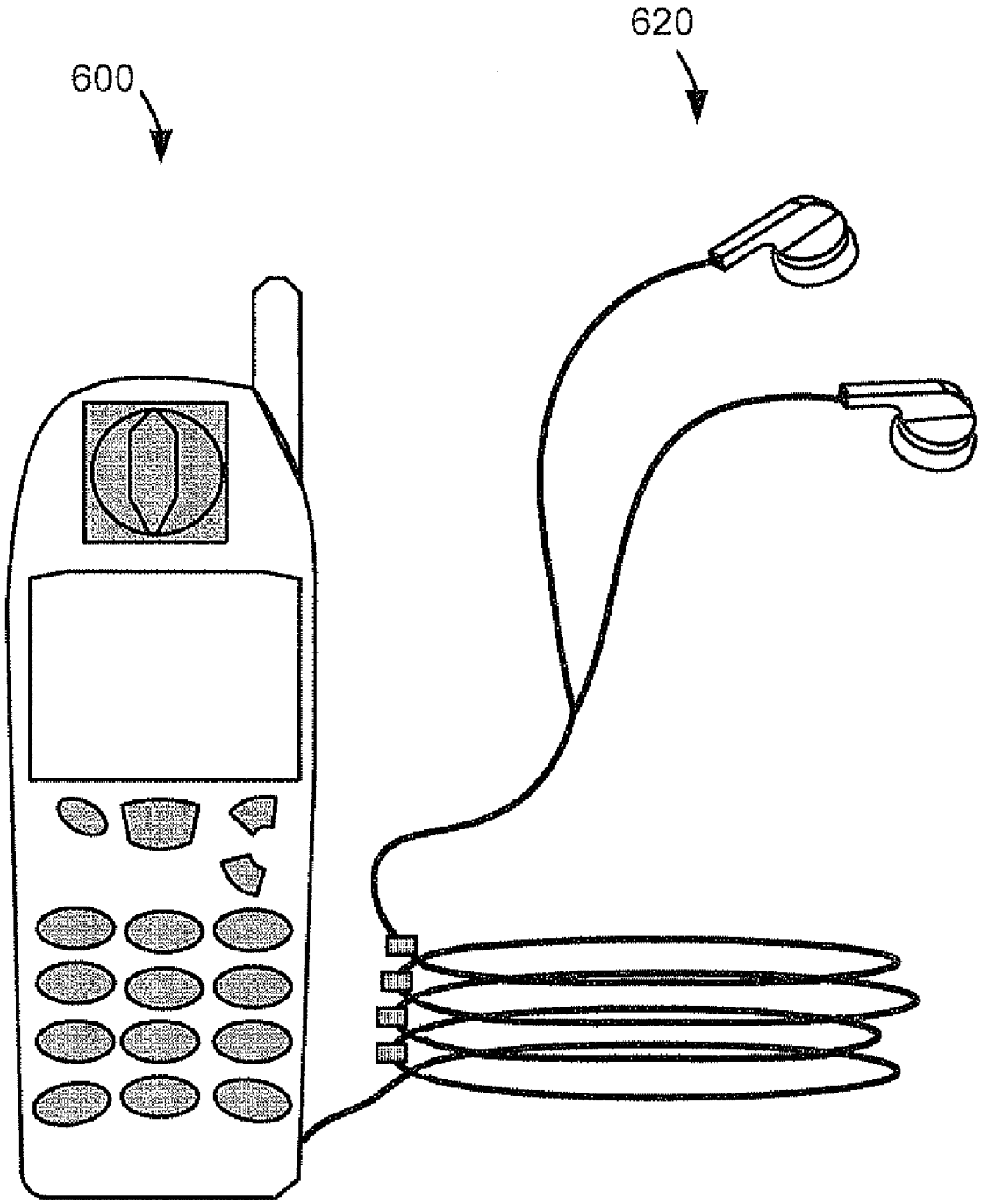

FIGS. 6A and 6B depict the use of the automatically folding cable described above, that includes magnets disposed on or within a length of the cable, with a cellular radio-telephone 600. As shown in FIG. 6A, a user may unfold and then connect a cable, such as the automatically folding cable described above with respect to FIG. 4A, to cellular radiotelephone 600 to, for example, use a "hands free" headset that includes ear-pieces and a microphone. The cable is shown in FIG. 6A in its unfolded state 610. After the user is through using the "hands free" headset, the user may release the cable, and the internal folding wire and the magnets, described above, may act to automatically fold the cable into its folded state 620, as shown in FIG. 6B.

CONCLUSION

Cables, such as cables used to interconnect electrical devices, may, consistent with principles of the invention, include an internal folding wire composed of a material that acts to automatically return the cable to a pre-defined folded configuration after the cable is unfolded by a user. Use of the internal folding wire maintains the cable in a folded formation when the cable is not in use, thus, preventing the cable from becoming entangled.

The foregoing description of implementations consistent with principles of the invention provides illustration and description, but is not intended to be exhaustive or to limit the invention to the precise form disclosed. Modifications and variations are possible in light of the above teachings, or may be acquired from practice of the invention. For example, implementations of the invention have been described as using an automatically folding cable for interconnecting an electrical device with an external device. Aspects of the invention, however, may be applied to any type of cable used in any type of application. As another example, implementations of the invention have been described as using an internal folding wire in conjunction with magnets disposed on or within the cable for automatically folding the cable. In some implementations, the magnets may be used by themselves without the internal folding wire being disposed within the cable.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A cable, comprising:

a sheath extending a length of the cable;

a flexible wire, disposed within the sheath, that runs a portion of the length of the cable; and magnets disposed on or within the sheath, where the magnets comprise electromagnets, and where, when a voltage is applied to the electromagnets, the electromagnets, in conjunction with the flexible wire, cause the cable to be folded in a pre-defined configuration.

2. The cable of claim 1, where the magnets are disposed at selected locations along the length of the cable to cause the cable to be folded in the pre-defined configuration.

3. The cable of claim 2, where the cable is deformable and returns to the pre-defined configuration, after being released from an unfolded configuration, due to attraction of the magnets to one another.

4. The cable of claim 1, where, when the voltage is removed from the electromagnets, the cable is unfolded from the pre-defined configuration.

5. The cable of claim 1, where the flexible wire is formed within the sheath in the pre-defined configuration.

6. The cable of claim 1, where the flexible wire is deformable and returns to the pre-defined configuration after being released from an unfolded configuration.

7. The cable of claim 1, where pre-defined configuration comprises a coiled configuration.

8. A cable, comprising:

a sheathing material extending a length of the cable; and magnets disposed on or within the sheathing material, where the magnets comprise electromagnets, and where, when a voltage is applied to the electromagnets, the electromagnets cause the cable to be folded in a pre-defined formation.

9. The cable of claim 8, where the magnets are disposed at selected locations along the length of the cable to fold the cable in the pre-defined formation.

10. The cable of claim 9, where the cable is deformable and returns to the pre-defined formation, after being released from an unfolded configuration, due to attraction of the magnets to one another.

11. The cable of claim 8, where the pre-defined formation comprises a coiled formation.

12. The cable of claim 8, where, when the voltage is removed from the electromagnets, the cable is unfolded from the pre-defined formation.

13. A system, comprising:

a cable; and electromagnets disposed on or within the cable, wherein the electromagnets cause at least one of:

the cable to be folded in a pre-defined configuration based on a voltage applied to the electromagnets, or the cable to be released from the pre-defined configuration based on the voltage.

14. The system of claim 13, where the electromagnets are disposed at selected locations along a length of the cable to fold the cable in the pre-defined configuration.

15. The system of claim 13, where the cable returns to the pre-defined configuration, from an unfolded configuration, due to attraction of the electromagnets to one another.

16. The system of claim 13, where the cable is released from the pre-defined configuration when the voltage is removed from being applied to the electromagnets.

17. The system of claim 13, further comprising:

a first electrical wire disposed within the cable;

a second electrical wire disposed within the cable;

a first device; and a second, different device connected to the first device via the first electrical wire, wherein the second device removes a voltage being applied to the electromagnets, via the second electrical wire, when the second device receives a call, to permit the cable to be unfolded from the pre-defined configuration.

18. A system, comprising:

a cable including one or more electrical wires and a flexible wire;

a mobile device;

a device connected to the mobile device via the one or more electrical wires included in the cable;

the flexible wire, disposed within the cable, that runs a portion of a length of the cable; and magnets disposed on or within the cable, where the magnets comprise electromagnets, and where, when a voltage is applied to the electromagnets, the electromagnets, in conjunction with the flexible wire, cause the cable to return to a pre-defined folded configuration when the cable has been unfolded.

19. The system of claim 18, where the flexible wire is formed within the cable in the pre-defined configuration.

20. The system of claim 18, where the pre-defined configuration comprises a coiled configuration.

21. The system of claim 18, where the magnets are disposed at selected locations along a length of the cable to cause the cable to return to the pre-defined configuration when the cable has been unfolded.

22. The system of claim 18, where the cable returns to the pre-defined configuration after being released from an unfolded state due to attraction of the magnets to one another.

23. The system of claim 18, where, when the voltage is removed from being applied to the electromagnets, the cable is unfolded from the pre-defined formation.

* * * * *